US005787331A

United States Patent [19]

Ohkuma et al.

[11] Patent Number: 5,787,331

[45] Date of Patent: Jul. 28, 1998

[54] CURL CORRECTION DEVICE OF AN IMAGE FORMING APPARATUS

[75] Inventors: Keiko Ohkuma, Matsudo; Kiyoharu Tanaka, Kawasaki; Tooru Matsuyama, Yokohama, all of Japan

[73] Assignee: Canon Kabushiki Kaisha, Japan

[21] Appl. No.: 867,766

[22] Filed: Jun. 3, 1997

Related U.S. Application Data

[63] Continuation of Ser. No. 570,572, Dec. 11, 1995, abandoned.

[30] Foreign Application Priority Data

| | | | |
|---|---|---|---|
| Dec. 14, 1994 | [JP] | Japan | 6-310545 |
| Feb. 21, 1995 | [JP] | Japan | 7-032123 |
| Oct. 24, 1995 | [JP] | Japan | 7-275558 |

[51] Int. Cl.[6] ..... G03G 15/00

[52] U.S. Cl. ..... 399/406; 162/271

[58] Field of Search ..... 399/406; 162/270, 162/271, 197; 271/188, 212, 209, 161

[56] References Cited

U.S. PATENT DOCUMENTS

| | | | |
|---|---|---|---|
| 4,591,259 | 5/1986 | Kuo et al. | 162/271 X |
| 4,926,358 | 5/1990 | Tani et al. | 355/207 X |
| 5,084,731 | 1/1992 | Baruch | 355/208 |
| 5,123,895 | 6/1992 | Mandel | 162/271 X |
| 5,153,662 | 10/1992 | Foos | 162/271 X |
| 5,202,769 | 4/1993 | Suzuki | 358/300 |
| 5,204,698 | 4/1993 | LeSueur et al. | 355/208 X |
| 5,245,393 | 9/1993 | Storlie et al. | 355/290 |
| 5,287,157 | 2/1994 | Miyazato et al. | 355/285 X |
| 5,357,327 | 10/1994 | Solano et al. | 355/282 |
| 5,392,106 | 2/1995 | Bigenwald et al. | 162/270 X |
| 5,394,227 | 2/1995 | Huffman et al. | 355/285 |
| 5,396,318 | 3/1995 | Asada | 355/285 |
| 5,434,029 | 7/1995 | Moser | 355/285 X |
| 5,467,178 | 11/1995 | Mui et al. | 355/285 |

FOREIGN PATENT DOCUMENTS 6-144679 5/1994 Japan .

*Primary Examiner*—Matthew S. Smith

*Attorney, Agent, or Firm*—Fitzpatrick, Cella, Harper & Scinto

[57] ABSTRACT

In order to correct curl of a recording sheet, having images recorded on both surfaces thereof, discharged from an image forming apparatus, the amount of a toner on a first surface of the recording sheet is stored in a memory. There is provided a unit for calculating the amount of correction of the curl by comparing the stored amount with the amount of the toner on a second surface of the sheet. In calculating the amount of correction of the curl, the amount of the toner, the kind, the thickness and the size of the sheet, the ambient temperature and humidity, and the like are used.

41 Claims, 12 Drawing Sheets

CURL CORRECTION DEVICE OF AN IMAGE FORMING APPARATUS

This application is a continuation of prior application Ser. No. 08/570,572 filed on Dec. 11, 1995, now abandoned.

BACKGROUND OF THE INVENTION

1. Field of the Invention

This invention relates to a device for correcting curl of a sheet in an image forming apparatus, and more particularly, to a device for correcting curl of a sheet in an image forming apparatus which can form images on both surfaces of the sheet and which includes a heat-roller fixing device.

2. Description of the Related Art

In general, in an image forming apparatus using an electrophotographic method, such as an electronic copier or the like, a toner image formed on a photosensitive drum is transferred onto a sheet, the transferred image is fixed by fusing a toner in a fixing device using a heat-roller method, and the sheet is discharged. In such an image forming apparatus, it has been known to dispose a postprocessing device, such as a sorter or the like, in order to facilitate postprocessing, such as sorting, stapling, punching, binding or the like of recording sheets. Since a recording sheet after image fixing by heat tends to produce curl due to contraction of a toner and swelling as result of water absorption of the sheet, a device for correcting curl of the sheet is, in some cases, provided between the image forming apparatus and the postprocessing device.

It is known that the amount of curl of a sheet changes depending on various conditions, such as image information (the amount of the toner), the kind of the sheet, the ambient temperature and humidity, and the like. Accordingly, in order to always appropriately correct curl of a sheet, the curl correction device is, in most cases, configured so as to be able to change the amount of correction of curl of the sheet in multiple steps in accordance with the above-described conditions detected within the image forming apparatus.

In the above-described conventional apparatus, however, since the amount of correction of curl of a sheet is changed based on image information of only one surface of the sheet, correction of curl is, in some cases, insufficient for a recording sheet having images formed on both surfaces thereof.

That is, since curl of a sheet having images formed on both surfaces thereof is mainly produced due to the difference between the amounts of contraction of the toner on the two surfaces, the amounts of the toner on the two surfaces must be compared with each other in order to determine the amount of correction of curl.

SUMMARY OF THE INVENTION

It is an object of the present invention to provide a curl correction device which can appropriately correct even curl of a recording sheet having images formed on both surfaces thereof by providing a sequence of storing image information of a first surface within a memory, then detecting image information of a second surface, and determining the amount of curl of the sheet by comparing the detected image information with the stored image information.

According to one aspect, the present invention, which achieves the above-described object, relates to a curl correction device of an image forming apparatus, including an image forming device for forming images on both surfaces of a sheet, a curl correction device for correcting curl of the sheet, a kind-information transmission device for transmitting information relating to a kind of the sheet, an image-information transmission device for transmitting information relating to the images formed on the sheet by the image forming device, and a controller for changing a curl correction capability of the curl correction device based on the kind information transmitted from the kind-information transmission device, and image information of a first surface and a second surface of the sheet transmitted from the image-information transmission device.

According to another aspect, the present invention relates to a curl correction device of an image forming apparatus, including an image bearing member for bearing an image to be transferred onto a sheet, a conveying path for conveying the sheet from a downstream side to an upstream side of the image bearing member in order to form an image on a second surface of the sheet having an image formed on a first surface thereof, a pair of rotating members for grasping the sheet having the images formed on the first surface and the second surface thereof and for guiding the sheet so as to be bent in a direction opposite to the direction of curl, a sheet-thickness sensor for detecting the thickness of the sheet, a density sensor for detecting the densities of the images formed on the sheet, and a controller for changing a curl correction capability of the pair of rotating members based on the thickness of the sheet detected by the sheet-thickness sensor, and the densities of the images on the two surfaces of the sheet detected by the density sensor.

According to still another aspect, the present invention relates to an image forming apparatus capable of recording images on both surfaces of a sheet material. The apparatus includes a heating fixing device for heating and fixing an image transferred onto a sheet material at an image forming portion, an inversion feeding device for inverting an image surface of the sheet material and guiding the sheet material to the image forming portion again, and a discharging device for conveying and discharging the sheet material to the outside of the apparatus. The apparatus also has first and second curl-habit correction devices. The first curl-habit correction device corrects a curl habit of the sheet material, on which an image has been formed, at a portion downstream from the heating fixing device in a sheet conveying direction and upstream from a branch portion of a conveying path to the inversion feeding device and a conveying path to the discharging device. The second curl-habit correction device corrects curl habit of the sheet material at a portion downstream from the branch portion.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

First Embodiment

Figure 1:
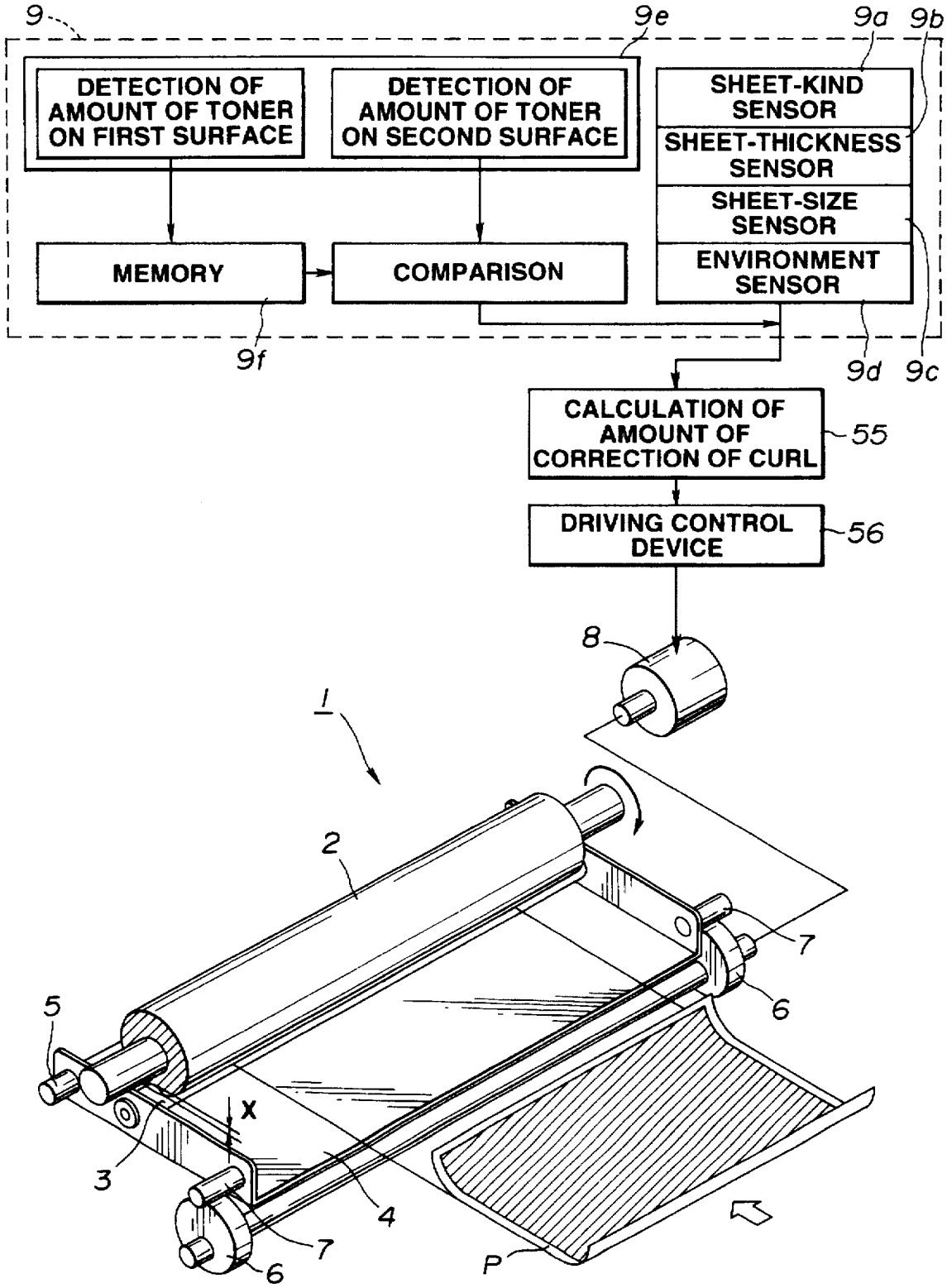
FIG. 1 is a detailed fragmentary view illustrating a curl correction device according to a first embodiment of the present invention.

FIG. 1 illustrates a principal portion of a curl correction device according to a first embodiment of the present invention.

In FIG. 1, a curl correction device 1 comprises a soft large-diameter upper roller 2 made of an elastic material, such as a silicone sponge or the like, and a metallic small-diameter lower roller 3 which is harder than the large-diameter upper roller 2.

By pressing the metallic lower roller 3 against the elastic upper roller 2, the elastic upper roller 2 is deformed to provide an upwardly convex nip along the outer diameter of the metallic lower roller 3, and thereby to correct normal curl (downwardly convex) of a sheet P passing through the nip.

The curl correction capability of the curl correction device 1 can be adjusted by changing the amount of deformation of the elastic upper roller 2, i.e., the amount of penetration x of the metallic lower roller 3 relative to the elastic upper roller 2. The amount of penetration x is changed by changing the distance between the rotation axes of the elastic upper roller 2 and the metallic lower roller 3 by swinging a pressing arm 4 for supporting the metallic lower roller 3 around a spindle 5 by the rotation of an eccentric cam 6. Cam followers 7 are fixed to the pressing arm 4. When the eccentric cams 6 rotate to raise the cam followers 7, the pressing arm 4 swings upward.

Figure 2:
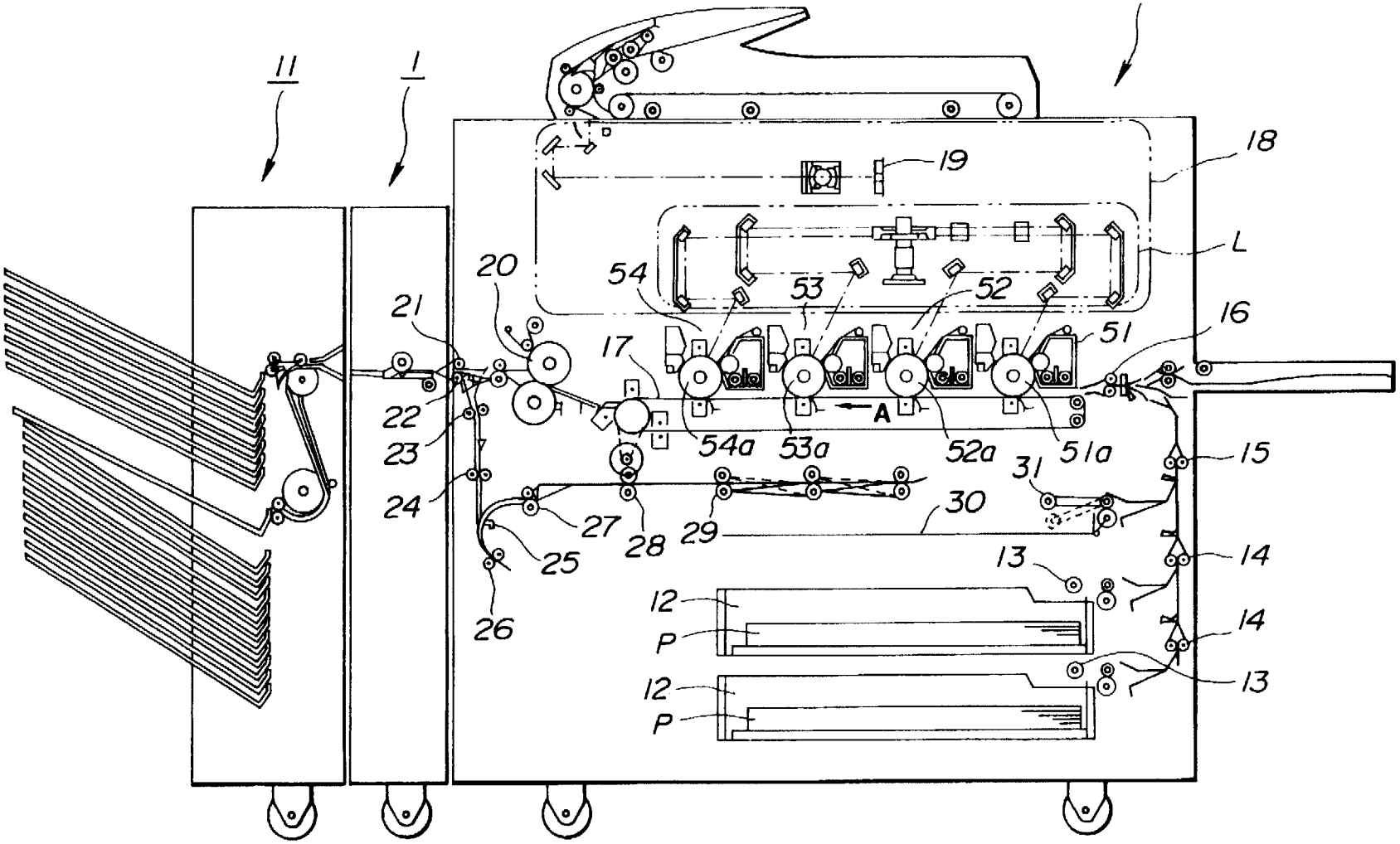
FIG. 2 is a diagram illustrating the curl correction device shown in FIG. 1 mounted between an image forming apparatus and a postprocessing device.

FIG. 2 is a diagram illustrating a state in which the above-described curl correction device 1 is mounted between an image forming apparatus 10 and a postprocessing device 11.

An image forming process in the image forming apparatus 10 will now be described.

When an image-formation starting signal has been provided, a first-feeding-roller solenoid (not shown) is turned on. A sheet P is fed from a cassette 12 by a pickup roller 13 within a sheet-feeding device, and passes through conveying rollers 14 and 15. After adjusting the timing of the sheet P by registration rollers 16, the sheet P is conveyed in the direction of an arrow A while being mounted on a belt conveying unit 17. Images made by toners having different colors are sequentially transferred onto the sheet P by first through fourth image forming stations 51–54 arranged in a line according to a known image transfer process, and a multicolor image is thereby formed.

When the image-formation starting signal has been provided, an image of an original mounted on an original-image reading device 18 (hereinafter termed a "reader") is separated into magenta, cyan, yellow and black color components by an optical reading sensor 19, such as a CCD (charge-coupled device) or the like, and is read and temporarily stored within an image memory as pixel data.

Image information of the original stored within the memory is written onto photosensitive drums 51*a*–54*a* for the respective colors by a laser optical system L, which emits laser light onto the respective photosensitive drums 51*a*–54*a* based on the pixel data as an image writing device or a laser-beam emitting device, so as to be transferred onto the sheet P as the sheet passes through the respective stations, with each color image being superposed on the preceding image or images.

The sheet P, on which a multicolor image has been transferred in the above-described processing, is fed from the belt conveying unit 17 to a fixing unit 20, which fixes the image using heat. When forming an image only on one surface of the sheet P, the sheet P, on which the image has been fixed, is discharged from the image forming apparatus 10 by sheet discharging rollers 21. When forming images on both surfaces of the sheet P, the sheet P passes through conveying rollers 23 and 24 by switching a flapper 22 using an actuator (not shown), and enters a branch portion. A comb-shaped resin sheet 25 is provided at the branch portion. When the sheet P enters the branch portion, the combshaped resin sheet 25 is deformed to pass the sheet P, which is fed to reversal rollers 26.

When the trailing edge of the sheet P has passed through the sheet 25, the reversal rollers 26 start to rotate in the reverse direction. The reversed sheet P is guided to conveying rollers 27 by the sheet 25, then passes through an oil cleaning unit 28 and conveying rollers 29, and is mounted on an intermediate tray 30 with the image surface placed upward.

The sheet P mounted on the intermediate tray 30 is fed by a pickup roller 31. An image is transferred and fixed on the other surface of the sheet P according to the same processing as in image formation on the first surface, and the sheet P is then discharged from the image forming apparatus 10.

In the above-described image forming apparatus 10, the sheet P having an image on one surface thereof is, in most cases, discharged in an state of normal curl in which the surface having the image is contracted.

Such normal curl of the sheet causes problems, such as a failure in sheet conveyance in the postprocessing device 11, incompletely stacked sheets, misalignment in stapling, misalignment between punched holes or the like, a decrease in the number of stacked sheets due to the curl, and the like.

Hence, the above-described curl correction device 1 is provided between the image forming apparatus 10 and the postprocessing device 11.

It is known that normal curl of a sheet is caused mainly by contraction of the toner heated and fused by thermal fixing rollers of the fixing unit 20 during air cooling after discharging the sheet. It is also known that the amount of curl changes depending on the density of the image on the sheet (the amount of the toner), the kind (the material, the stiffness, the thickness, the size, the direction of carding, and the like) of the sheet, and the ambient temperature and humidity. It is also known that there is a correlation between each factor and the amount of curl.

For example, as the density of the image is higher and therefore the amount of the toner transferred to the sheet is larger, the contraction of the toner after discharging the sheet exerts greater influence on the sheet, and therefore the amount of curl increases. On the other hand, as the sheet has higher stiffness, the contraction of the toner exerts less influence on the sheet, and therefore the amount of curl decreases. As the humidity rises, elongation of the sheet due to water absorption after first discharging water by the fixing rollers is larger. The elongation is larger for a surface of the sheet on which an image has not been transferred than the other surface on which an image has been transferred because fixed toner particles prevent penetration of water. Accordingly, normal curl of the sheet increases.

In the present embodiment, by detecting in advance the above-described factors as curl information, the amount of curl of the sheet can be predicted, and the curl is sufficiently corrected so that operation of the postprocessing device 11 is not adversely affected. This result is achieved in the present invention by changing the curl correction amount based on the detected curl information.

Curl-information detection means 9, shown in FIG. 1, comprising a sheet-kind sensor 9*a*, a sheet-thickness sensor 9*b* and a sheet-size sensor 9*c*, serving as sheet-kind detection means or sheet-kind-information transmission means, and the like, is provided, for example, in a sheet-feeding portion of the image forming apparatus 1. Detection information relating to the kind of the sheet (discrimination between ordinary paper and an OHP (overhead projector) sheet), the thickness of the sheet, the size of the sheet and the like, and detection information relating to the temperature and humidity from an environment sensor 9*d*, serving as environment-information transmission means, provided within the image forming apparatus 10 may be utilized. Toner-amount detection means, serving as image-information transmission means, may, for example, have a configuration of calculating the amount of the toner, serving as image information, by measuring the potential on the photosensitive drum by a conventional potential sensor 9*e*, or a configuration of predicting the amount of the toner from the number of dots counted by a laser controller when converting the read image into laser light (a video count value).

It is known that the amount of curl of a sheet having images formed on both surfaces thereof in the image forming apparatus 10 depends on the difference between the amounts of contraction of the first surface (the lower surface when the sheet is discharged) and the second surface (the upper surface when the sheet is discharged), i.e., the difference between the amounts of the toner. Accordingly, when recording on both surfaces of a sheet is selected on the operation panel, by providing a sequence of storing the detected amount of the toner on the first surface in a memory 9*f* shown in FIG. 1, and enabling to compare the stored amount with the detected amount of the toner on the second surface, the amount of correction of curl based on the result of the comparison can be calculated. Hence, as in the case of recording only on one surface of a sheet, appropriate correction of normal curl of a sheet in accordance with the amount of curl can be effected.

Figure 3:
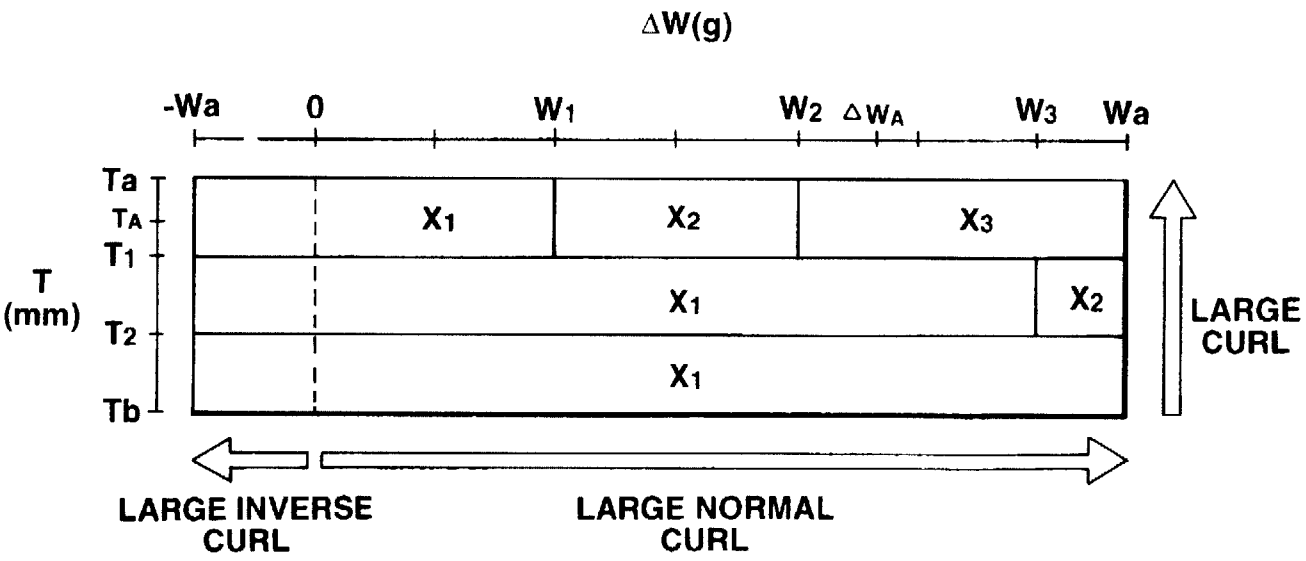
FIG. 3 is a table for setting the amount of penetration for controlling the curl correction device shown in FIG. 1.

FIG. 3 illustrates an example of control of the amount of penetration in the curl correction device.

In FIG. 3, the ordinate represents the thickness (T) of the sheet. Measured values of the thicknesses of sheets by the sheet-thickness sensor 9*b* are divided into a plurality of segments according to thresholds $T_1$ and $T_2$, and are stored in a memory within curl-correction-amount calculation means 55 shown in FIG. 1. In FIG. 3, $T_a$ and $T_b$ represent the minimum thickness and the maximum thickness of the sheet recommended in the image forming apparatus 10, and the relationship of $T_a<T_1<T_2<T_b$ holds.

In FIG. 3, the abscissa represents the amount of the toner ($\Delta W$) per unit area, which corresponds to the average image density. Accordingly, if the total amount of the toner used in image recording caculated from the above-described video count value and the control value of the potential on the surface of the photosensitive drum is represented by $W_T$, and the area of the entire recording region of the sheet calculated from detection of the sheet size is represented by A, the amount of the toner W is expressed by $W=W_T/A$. In the case of image recording on both surfaces of the sheet, the amount of the toner $\Delta W$ as the final condition for determining the amount of correction of curl is represented by $\Delta W=W_U-W_D=(W_{TU}-W_{TD})/A$, where $W_D=W_{T\,D}/A$ is the amount of the toner on the first surface (the lower surface when the sheet is discharged), and $W_U=(W_{TU}/A)$ is the amount of the toner on the second surface (the upper surface when the sheet is discharged). In FIG. 3, $W_a$ is the maximum amount of the toner (image density) which can be obtained in the image forming apparatus 10. Since $0\leqq W_U$, and $W_D\leqq W_a$, $-W_a\leqq W\leqq W_a$. The case of image recording only on one surface of the sheet corresponds to a case in which $W_D=0$ in the above-described expression, i.e., $\Delta W=W_U$ (the amount of the toner on the upper surface when the sheet is discharged), and the range of $0\leqq W\leqq W_a$ shown in FIG. 3 may be utilized.

Figure 4:
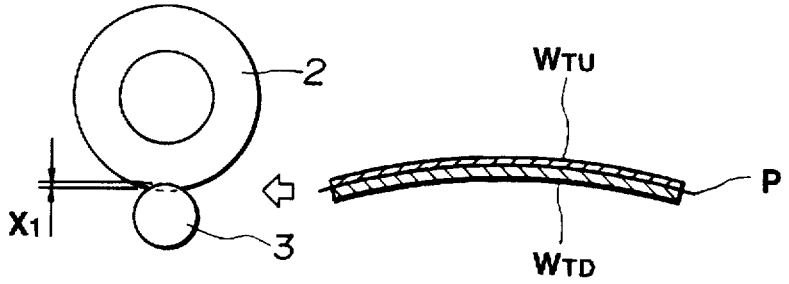
FIG. 4 illustrates an upper elastic roller 2 and a lower metallic roller 3 when the amount of penetration equals $x_1$.
Figure 5:
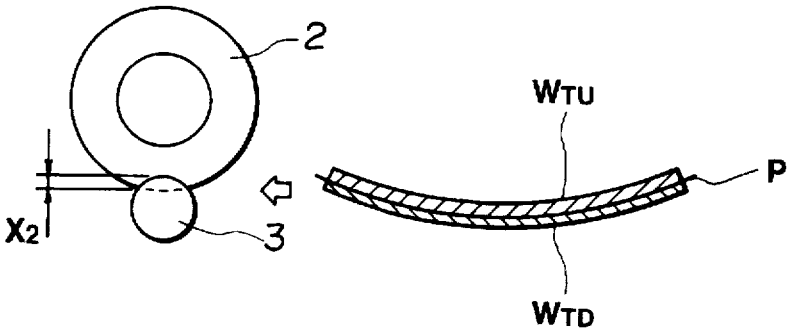
FIG. 5 illustrates the upper elastic roller 2 and the lower metallic roller 3 when the amount of penetration equals $x_2$.
Figure 6:
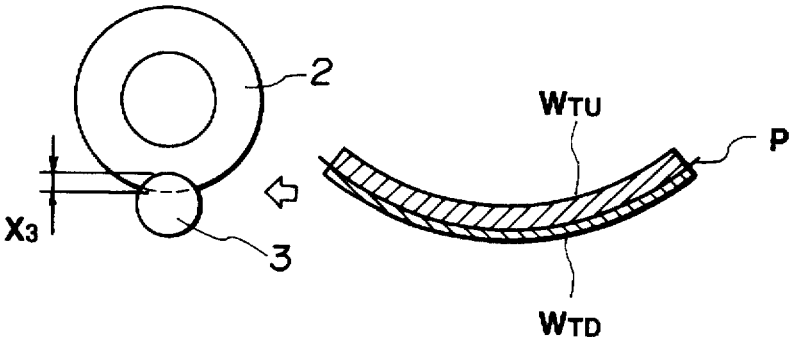
FIG. 6 illustrates the upper elastic roller 2 and the lower metallic roller 3 when the amount of penetration equals $X_3$.

Changing of the amount of penetration x to adjust the curl correction capability of the curl correction device 1 can be performed in multiple steps, as shown in FIGS. 4–6, by the rotation of the above-described eccentric cam 6. Respective amounts of penetration $x_1$, $x_2$ and $x_3$ are related as follows: $0\leqq x_1\leqq x_2\leqq x_3$. The amount $x_1$ is made to be as close to 0 as possible, and corresponds to a state of sheet feeding in which no curl correction force is exerted. The curl correction force increases in the order of $x_2$ and $x_3$.

In the above-described configuration, by providing thresholds $W_1$, $W_2$ and $W_3$ for the amount of the toner $\Delta W$, and reading an optimum amount of penetration x for the value of the thickness of the sheet T from a table for setting the amount of penetration x provided as the graph shown in FIG. 3, the curl correction capability can be appropriately controlled in accordance with the amount of curl.

The table for setting the amount of penetration x shown in FIG. 3 is stored in the memory within the curl-correction-amount calculation means 55. The curl-correction-amount calculation means 55 determines an optimum amount of penetration x from a sheet-thickness-value signal T transmitted from the sheet-thickness sensor 9*b*, and the difference between the amounts of the toner per unit area of the first surface and the second surface detected by the toner-amount detection means 9*e*, based on the penetration-amount setting table which stores optimum amounts of penetration x.

For example, the curl-correction-amount calculation means 55 determines that the optimum amount of penetration is $x_3$ when the thickness of a copy sheet having images formed on both surfaces thereof is $T_A$ ($T_a>T_A>T_1$), and the difference between the amounts of the toner is $\Delta W_A$ ($W_2<\Delta W_A<W_3$).

As shown in FIG. 1, a driving control device 56 rotates the cam 6 by controlling the drive of a motor 8 so that the amount of penetration of the metallic lower roller 3 relative to the elastic upper roller 2 equals the optimum amount of penetration determined by the curl-correction-amount calculation means 55.

The above-described control of the amount of penetration is for ordinary paper. The amount of penetration for a recording sheet, such as an OHP (overhead projector) resin film or the like, which has the property of being little influenced by curl due to water absorption and contraction of the toner, may be set to $x_1$ without using the table shown in FIG. 3 when it is determined that such a sheet is used.

When the amount of curl changes depending on the ambient temperature and humidity, the thresholds $W_1$, $W_2$ and $W_3$ for the amount of the toner may be dealt with as variables relating the the detected temperature and humidity. For example, by shifting the thresholds to a minus side for hightemperature and high-humidity environment because the amount of curl increases, and shifting the threshold to a plus side for low-temeparature and low-himidity environment because the amount of curl decreases, appropriate control of curl correction can be effected in any environment.

Although in the present embodiment, the values of the thickness of the sheet and the amount of penetration are switched in three steps, the present invention is not limited to such an approach. For example, in order to provide an arbitrary amount of penetration determined by the thickness of the sheet and the amount of the toner, stepless control capable of stopping the cam at an arbitrary angle may be adopted.

The above-described control of switching the curl correction capability of the curl correction device is more effective for an image forming apparatus in which the maximum amount of the toner ($W_a$) is large and the amount of the toner greatly fluctuates depending on images. The control is, of course, particularly effective for color copiers in which an image is formed by superposing toners having four colors on a single recording sheet, because compared with monochrome copiers, the amount of the toners supplied to the recording sheet is considerably larger, and therefore the amount of curl due to contraction of the toners greatly fluctuates.

Second Embodiment

In the first embodiment, a description has been provided of only correction of normal curl of a recording sheet having images formed on both surfaces thereof. However, a sheet having images formed on both surfaces thereof is discharged, in some cases, in a state of inverse curl when the amount of the toner on the first surface of the sheet (the lower surface when the sheet is discharged) is larger than the amount of the toner on the second surface of the sheet (the upper surface when the sheet is discharged), because the amount of contraction of the toner on the first surface is greater. Since inverse curl of a sheet is considerably corrected by the weight of the sheet in contrast to the case of normal curl, fewer problems occur in the postprocessing device 11. However, when a large number of sheets are mounted, incomplete stacking of sheets, misalignment in stapling, misalignment between punched holes, or the like may occur.

Figure 7:
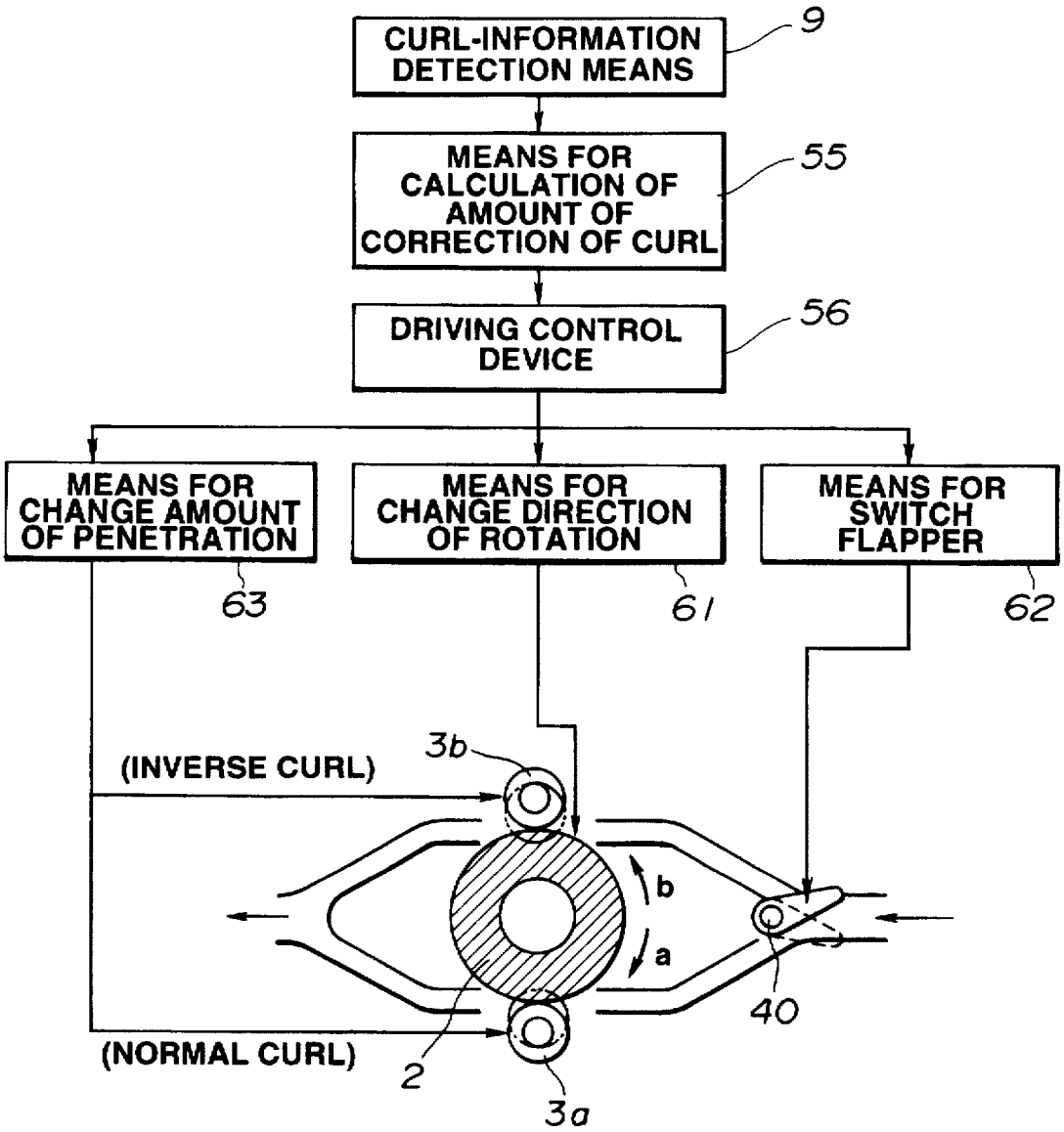
FIG. 7 is a fragmentary cross-sectional view illustrating a curl correction device according to a second embodiment of the present invention.

Accordingly, in a second embodiment of the present invention, as shown in FIG. 7, two metallic rollers and two mechanisms for switching the amount of penetration of the metallic rollers having the same configuration as in the first embodiment are provided above and below an elastic roller 2, so that appropriate correction of curl can be performed also for inverse curl of a sheet.

That is, sheet-feeding-path switching means 40, such as a flapper or the like, is provided at a portion upstream from the pair of rollers. In the case of normal curl of the sheet, curl is corrected by switching the amount of penetration of a lower metallic roller 3*a* in accordance with the amount of correction of curl calculated by the calculation means 55, and the driving control device 56 and means for changing the direction of rotation 61 drive the elastic roller 2 in the direction of an arrow a, as in the first embodiment.

In the case of inverse curl of the sheet (the amount of the toner on the first surface>the amount of the toner on the second surface), curl can be corrected by the flapper 40 lowered by flapper switching means 62 to the position indicated by broken lines, the amount of penetration of an upper metallic roller 3*b* is changed by means for changing the amount of penetration 63 in accordance with the calculated amount of correction of curl, and driving the elastic roller 2 in the direction of an arrow b.

As described above, by providing the metallic rollers 3*a* and 3*b* and the mechanisms for switching the amount of penetration of the rollers above and below the elastic roller 2, a curl correction device capable of correcting both normal curl and inverse curl of a sheet can be provided, so that adaptability of the sheet in the postprocessing device 11 is further improved.

Third Embodiment

Figure 8:
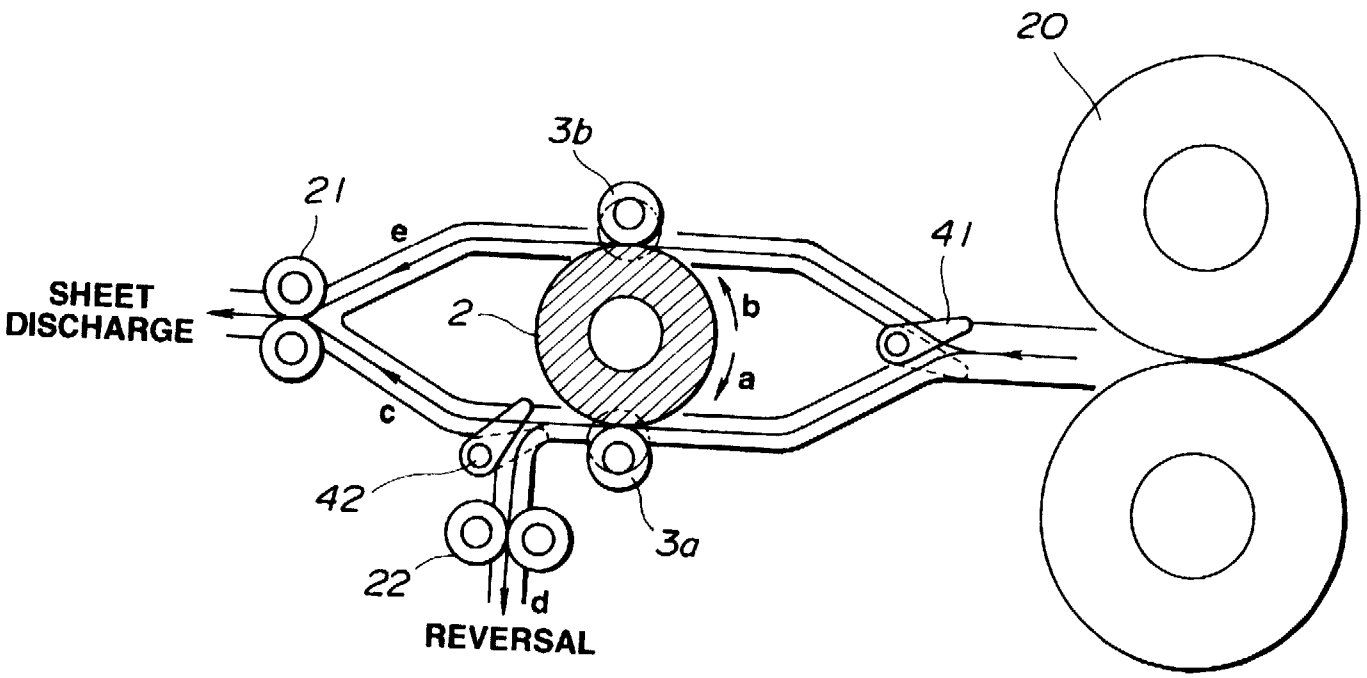
FIG. 8 is a fragmentary cross-sectional view illustrating a curl correction device according to a third embodiment of the present invention.

As shown in FIG. 8, by disposing the bidirectional curl correction device of the second embodiment between the fixing rollers 20 and a branch point of a sheet-discharging path and a reversal path within the image forming apparatus 10, curl correction after image recording on the first surface of a recording sheet for forming images on both surfaces thereof can be performed.

In FIG. 8, when performing image recording only on one surface of a sheet, a sheet path c is formed by raising a first flapper 41 provided behind the fixing rollers 20 and lowering a second flapper 42 provided at the branch point, and the sheet is discharged by sheet-discharging rollers 21 while correcting upper curl by the lower metallic roller 3*a*.

When performing image recording on a first surface of a sheet for forming images on both surfaces thereof, a sheet path d is formed by raising the first flapper 41 and raising the second flapper 42, and the sheet is guided to the reversal path and between rollers 22 after correcting upper curl by the lower metallic roller 3*a*. When performing image recording on a second surface of the sheet, the sheet is discharged by the sheet-discharging rollers 21 after peforming appropriate curl correction according to the control of curl correction described in the second embodiment by selecting the normal-curl correction path c or an inversecurl correction path e between rollers 3*b* and 2 based on data of comparison of image information on the first surface and the second surface.

According to such a configuration, curl can be corrected even for a sheet having an image formed on a first surface thereof, and the sheet is maintained flat within the reversal path until fixing of an image on a second surface is performed. Hence, conveyability during reversal is improved.

Fourth Embodiment

Figure 9:
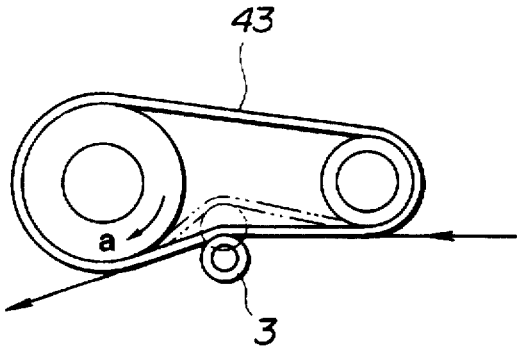
FIGS. 9 and 10 are fragmentary cross-sectional views illustrating a curl correction device according to a fourth embodiment of the present invention.
Figure 10:
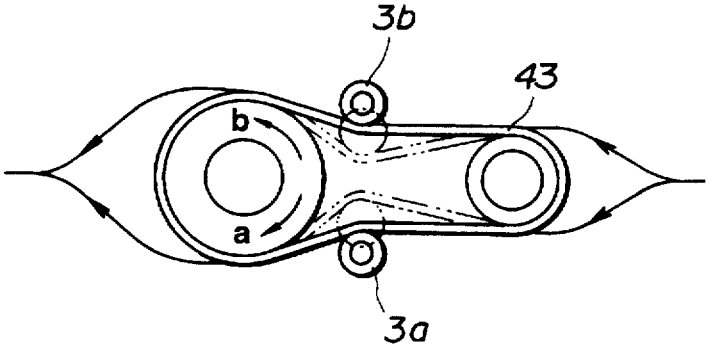

In the first through third embodiments, the curl correction device is configured by combination of the soft large-diameter roller 2 and the hard small-diameter roller 3. However, as shown in FIGS. 9 and 10, the same effects as in the above-described embodiments may, of course, be obtained by adopting a configuration in which a belt 43 is used instead of the elastic roller 2, and curl of a sheet is corrected by forming a nip along the outer diameter of the metallic roller 3 (FIG. 9) or rollers 3*a* and 3*b* (FIG. 10) by causing the metallic roller 3 or rollers 3*a* and 3*b* to penetrate relative to the belt 43.

Fifth Embodiment

Figure 11:
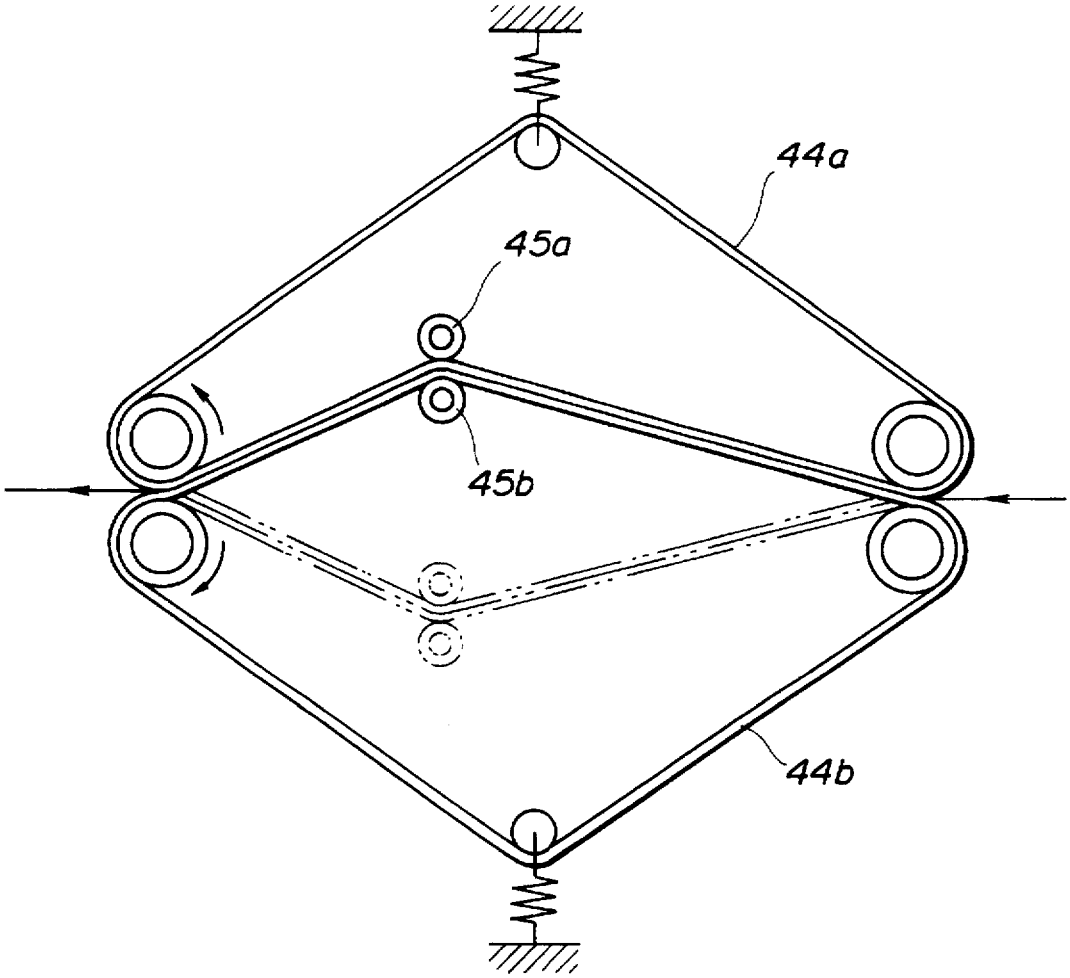
FIG. 11 is a fragmentary cross-sectional view illustrating a curl correction device according to a fifth embodiment of the present invention.

As shown in FIG. 11, a bent path can be formed in an arbitrary direction by adopting a configuration in which a pair of belts 44*a* and 44*b* are provided so as to face each other, and a pair of metallic rollers 45*a* and 45*b*, serving as idlers, are moved vertically.

In such a case, switching of the sheet path and switching of the direction of rotation of driving pulleys become unnecessary. Hence, such an approach is effective for simplifying the operation sequence.

In addition, by dividing the configuration above and below the sheet path in a simple manner, a sheet jammed in the bent path can be easily removed. Hence, operability when removing a jam is greatly improved.

Sixth Embodiment

A description will now be provided of an image forming apparatus according to a sixth embodiment of the present invention with reference to the drawings. In the present embodiment, an electrophotographic copier is illustrated as the image forming apparatus.

Figure 12:
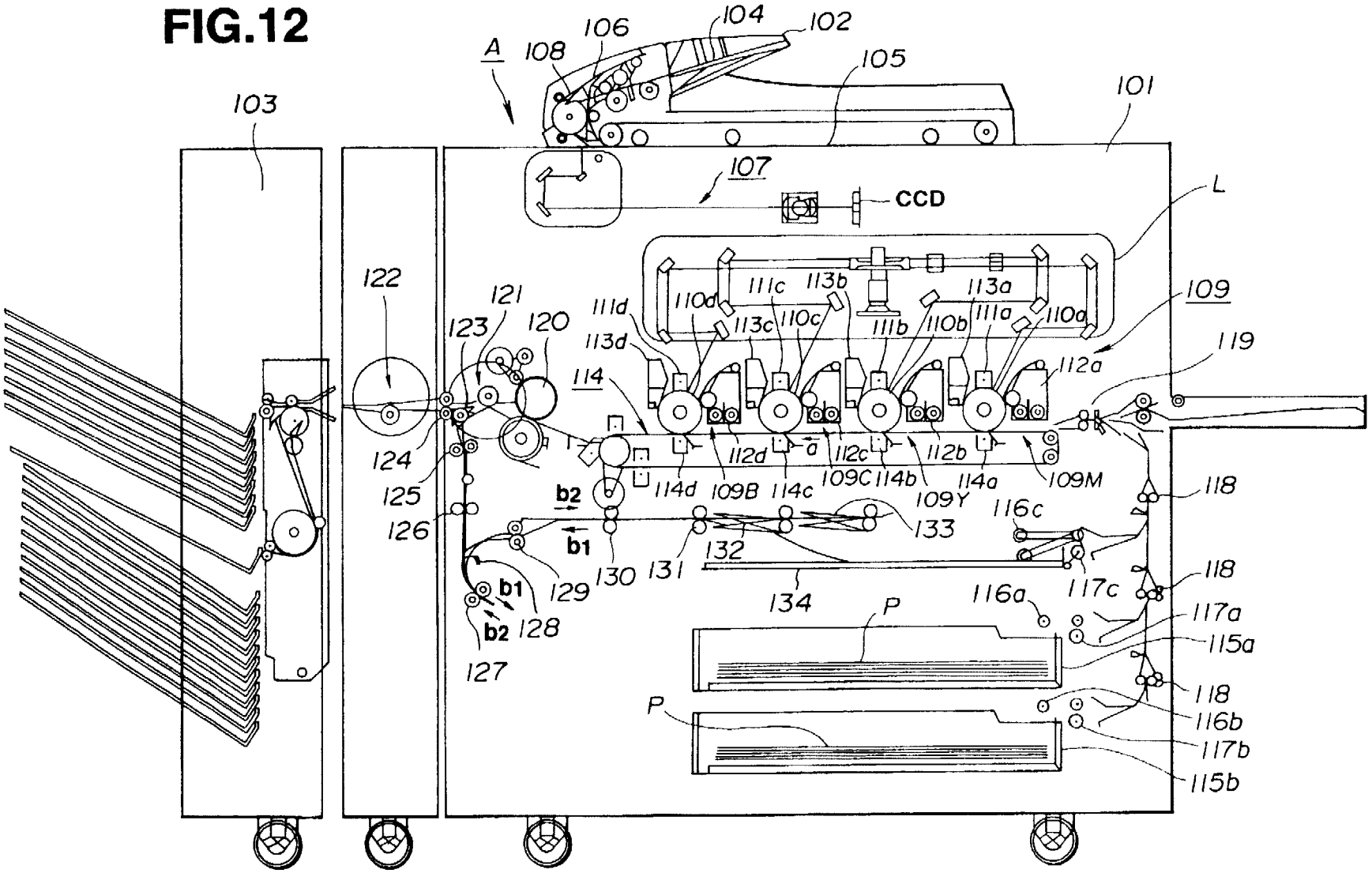
FIG. 12 is a schematic cross-sectional view illustrating a color copier capable of recording images on both surfaces of a sheet according to a sixth embodiment of the present invention.

As shown in FIG. 12, in an electrophotographic copier A, serving as the image forming apparatus, an automatic original feeder 102 is disposed at an upper portion of a main body 101 of the color copier capable of recording images on both surfaces of a sheet, and a sorting device 103 is disposed at the sheet discharging side via a sheetcurlhabit correction device (to be described later).

In the automatic original feeder 102, originals (not shown) mounted on an original mount 104 are individually separated from the lowermost sheet, and each of the separated sheets is fed onto platen glass 105 of the main body 101 of the copier via a path 106. An image on the original is read by an optical reading system 107 of the main body 101 of the copier, comprising a CCD and the like. After reading the image, the original is discharged onto the uppermost surface of the original mount 104 via a path 108.

The main body 101 of the copier includes an image forming unit 109 comprising image forming stations 109M, 109Y, 109C and 109B corresponding to magenta, yellow, cyan and black colors, respectively, arranged in a line. The image forming stations 109M–109B comprise photosensitive drums 110*a*–110*d*, serving as image bearing members for the respective colors, chargers 111*a*–111*d*, serving as process means for operating on the respective drums, developing units 112*a*–112*d*, cleaning units 113*a*–113*d*, and the like, respectively. A belt conveying unit 114, including transfer units 114*a*–114*d* for transferring toner images formed on the respective drums onto a sheet material P is disposed below the image forming unit 109. A laser unit L, serving as an image writing device for decomposing image information read by the optical reading system 107 into respective color components and exposing the respective drums with the corresponding color components, is disposed at an upper portion of the main body 101 of the copier.

Cassettes 115*a* and 115*b* accommodating sheets of the sheet material P are mounted at a lower portion of the main body 101 of the copier so as to be drawable to the front side of the main body 101 of the copier. The sheets of the sheet material P accommodated within the cassettes 115*a* or 115*b* are individually separated and fed from the uppermost sheet by pickup rollers 116*a* or 116*b*, and a pair of separation rollers 117*a* or 117*b*, respectively. Each of the separated sheets is fed to a pair of registration rollers 119 via a sheet conveying path, comprising a plurality of pairs of conveying rollers 118 and the like, and is fed to the image forming portion 109 at an appropriate timing.

While the sheet material P fed to the image forming portion 109 is conveyed in the direction of an arrow a by the belt conveying unit 114, images formed on the photosensitive drums of the respective image forming stations according to a known image forming process are sequentially transferred while being superposed onto the sheet material P to form a multicolor image. The sheet material P on which the multicolor image has been formed is fed to a fixing unit 120 by the belt conveying unit 114, and the transferred image is fixed by heat.

Figure 13A:
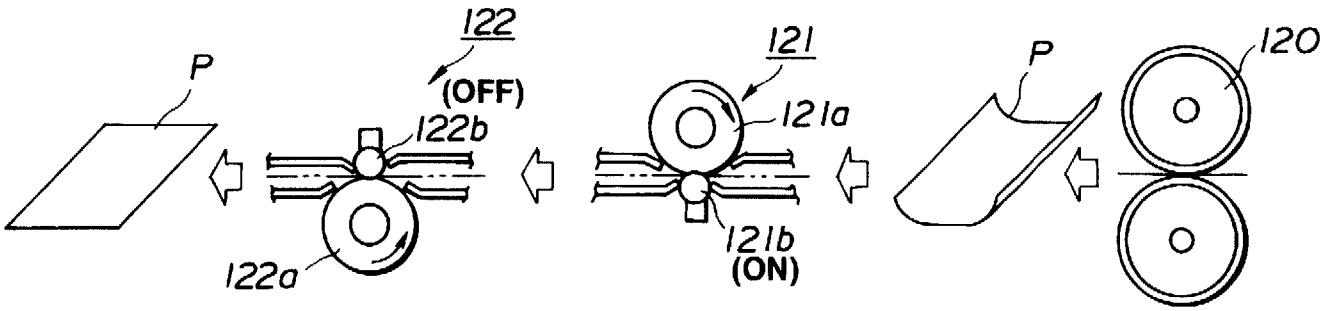
FIGS. 13(*a*) through 13(*c*) are diagrams illustrating curl correction means of the color copier shown in FIG. 12.
Figure 13B:
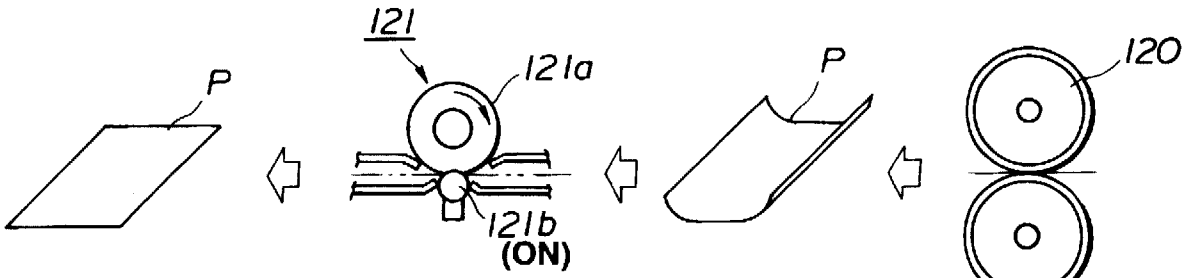
Figure 13C:
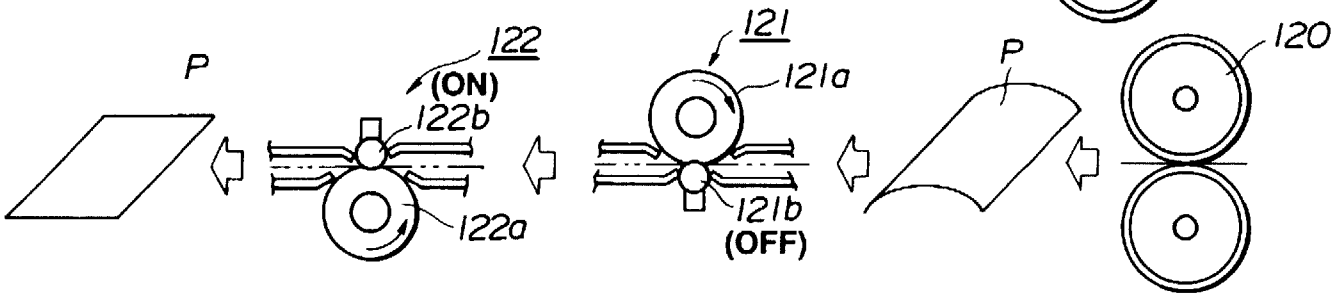

A description will now be provided of curl correction means for correcting curl of the sheet material P produced after fixing by heat by the fixing unit 120, with reference to FIGS. 12 through 13(*c*). A pair of first curl correction rollers 121 are disposed at a portion downstream from the fixing unit 120 in the sheet conveying direction and upstream from a branch path for guiding the sheet material to the discharging side or to the refeeding side, and a pair of second curl correction rollers 122 are disposed at a portion downstream from the branch path and at the sheet discharging side. A flapper 123 capable of being switched for regulating the moving direction of the sheet material to the discharging side or to the refeeding side is provided at the branch path. A pair of conveying rollers 124 for conveying and discharging the sheet material P outside the main body 101 of the copier are disposed at the discharging side. Pairs of conveying rollers 125 and 126, and a pair of inversion conveying rollers 127 for inverting the surface of the sheet material P and then feeding the sheet material P to an intermediate tray (to be described later) are disposed at the refeeding side.

As shown in FIGS. 13(*a*) through 13(*c*), the pairs of curl correction rollers 121 and 122 comprise soft rollers 121*a* and 122*a*, made of a sponge or the like, and hard rollers 121*b* and 122*b* having a diameter smaller than the diameter of soft rollers 121*a* and 122*a*, respectively. By grasping and conveying the sheet material P between these pairs of rollers, curl of the sheet material P is corrected. More specifically, the pair of first curl correction rollers 121 comprise the soft roller 121*a* disposed at the upper-surface side of a sheet conveying path, and the hard roller 121*b* disposed at the lower-surface side of the sheet conveying path, so as to provide the sheet material P with convex curl. The pair of second curl correction rollers 122 comprise the soft roller 122*a* disposed at the lower-surface side of the sheet conveying path, and the hard roller 122*b* disposed at the upper-surface side of the sheet conveying path, so as to provide the sheet material P with concave curl.

The curl correction capability of the hard rollers 121*b* and 122*b* is higher as the diameter is smaller. For example, if each of the soft rollers 121*a* and 122*a* comprises a sponge roller having an outer diameter of about 20 mm and a rubber hardness (ASKER C) of 25°, the outer diameter of the hard rollers 121*b* and 122*b* is preferably equal to or less than 12 mm, and more preferably, between 8 mm and 6 mm, in order to perform proper curl correction. Each of the soft rollers 121*a* and 122*a* is not limited to a large-diameter sponge roller, but may, for example, be configured by a soft belt member.

According to the above-described configuration, when an image is to be formed only on one surface of the sheet material P, after image fixing by heat by the fixing unit 20, the sheet material P passes through the pair of first curl correction rollers 121, then passes through the pair of second curl correction rollers 122 via the pair of conveying rollers 124, and is discharged and mounted onto a discharging tray (not shown) or the sorting device 103. At that time, as shown in FIG. 13(*a*), since the sheet material P after image fixing by heat has concave curl with respect to the image surface, inverse curl is provided for the sheet material P by turning on the pair of first curl correction rollers 121 for providing convex curl, in order to correct the curl. When passing through the pair of second curl correction rollers 122, the sheet material is flat. Hence, the pair of rollers 122 remain in an OFF state without providing curl, and operates only as a pair of conveying rollers.

When images are to be formed on both surfaces of the sheet material P, after image fixing by heat by the fixing unit 120, the sheet material P after image formation on one surface thereof passes through the pair of first curl correction rollers 121, is then guided to the refeeding side by switching of the flapper 123, then passes through the pairs of conveying rollers 125 and 126, and enters the pair of inversion conveying rollers 127 via a comb-shaped resin sheet 128 disposed at the branch path. As shown in FIG. 13(*b*), the sheet material P passing through the pair of first curl correction rollers 121 is flat because the concave curl with respect to the image surface has been corrected. Hence, the sheet material P smoothly enters the pair of inversion conveying rollers 127. The pair of inversion conveying rollers 127 can rotate both in normal and reverse directions. Hence, when the leading edge of the sheet material P has passed through the resin sheet 128, the pair of inversion conveying rollers 127 rotate in the normal direction to convey the sheet material P in the direction of an arrow $b_1$. When the trailing edge of the sheet material P has passed through the resin sheet 128, the pair of inversion conveying rollers 127 rotate in the reverse direction to convey the sheet material P in the direction of an arrow $b_2$.

Accordingly, when the trailing edge of the sheet material P has passed through the resin sheet 128 and the pair of inversion conveying rollers 127 rotates in the reverse direction, the sheet material P is guided toward a pair of conveying rollers 129 by the resin sheet 128. The sheet material P then passes through an oil cleaning unit 130 and a pair of conveying rollers 131, and is guided to an intermediate tray 134 by vertical movement of flappers 132 and 133 driven by an actuator (not shown) in accordance with the size of the sheet material P. The leading edge of the sheet material P is adjusted to the distal end of the intermediate tray 134 by this vertical movement of the flappers 132 and 133, and the sheet material P is discharged and mounted onto the tray 134 in a state in which the image surface is placed upward. Since the sheet material P is flat also at that time because the curl is corrected by the pair of first curl correction rollers 121, the sheet material P is held in a stable state in which no curl is present.

In order to form an image on the second surface of the sheet material P held in the intermediate tray 134, the above-described copying operation is started when the user has exchanged the original and depressed a start button on an operation unit (not shown), or when the next original has been automatically fed from the automatic original feeder 102 controlled by a microprocessor incorporated in the main body 101 of the copier. As in the copying operation on the first surface of the sheet material P, sheets of the sheet material P mounted on the intermediate tray 34 are individually separated and fed from the uppermost sheet by a pickup roller 116*c* and a pair of separation rollers 117*c*. Each of the fed sheets is fed to the pair of registration rollers 119 via the sheet feeding path, comprising the plurality of pairs of conveying rollers 118 and the like, and is fed to the above-described image forming portion 109 at an appropriate timing. While the sheet material P fed to the image forming portion 109 is conveyed in the direction of the arrow a by the belt conveying unit 114, images formed on the photosensitive drums of the respective image forming stations according to a known image forming process are sequentially transferred while being superposed onto the sheet material P to form a multicolor image. The sheet material P on which the multicolor image has been formed is fed to the fixing unit 120 by the belt conveying unit 114, and the transferred image is fixed by heat.

After image fixing by heat by the heating unit 120, the sheet material P having images formed on both surfaces thereof passes through the pair of first curl correction rollers 121, then passes through the pair of second curl correction rollers 122 via the pair of conveying rollers 124, and is discharged and mounted onto the discharging tray or the sorting device 103.

When the sheet material P after image fixing by heat has concave curl in a state in which the second image surface is placed upward, as shown in FIG. 13(*a*), inverse curl is provided for the sheet material P by turning on the pair of first curl correction rollers 121 for providing convex curl, in order to correct the curl. When passing through the pair of second curl correction rollers 122, the sheet material P is flat. Hence, the pair of rollers 122 remain in an OFF state without providing curl, and operates only as a pair of conveying rollers. When the sheet material P has convex curl in a state in which the second image surface is placed upward, as shown in FIG. 13(*c*), the pair of first curl correction rollers 121 remain in an OFF state and operate only as a pair of conveying rollers, and the pair of second curl correction rollers 122 for providing convex curl are turned on to provide inverse curl for the sheet material P and correct the curl.

That is, by operating at least one of the pair of first curl correction rollers 121 and the pair of second curl correction rollers 122, curl of the sheet material P having images formed on both surfaces thereof can be corrected to provide a flat state. Hence, the sheet material P conveyed and discharged onto the discharging tray or the sorting device 103 is maintained in a stable state in which no curl is present.

In the present embodiment, the pair of second curl correction rollers 122 are disposed at a space between the main body 101 of the copier and the sorting device 103. Hence, when a sheet jam occurs between the main body 101 of the copier and the sorting device 103, the jam can be processed at the side upstream of the device as when jam occurs in the main body 101 of the copier, without moving the sorting device 103 as in conventional cases.

Seventh Embodiment

Figure 14:
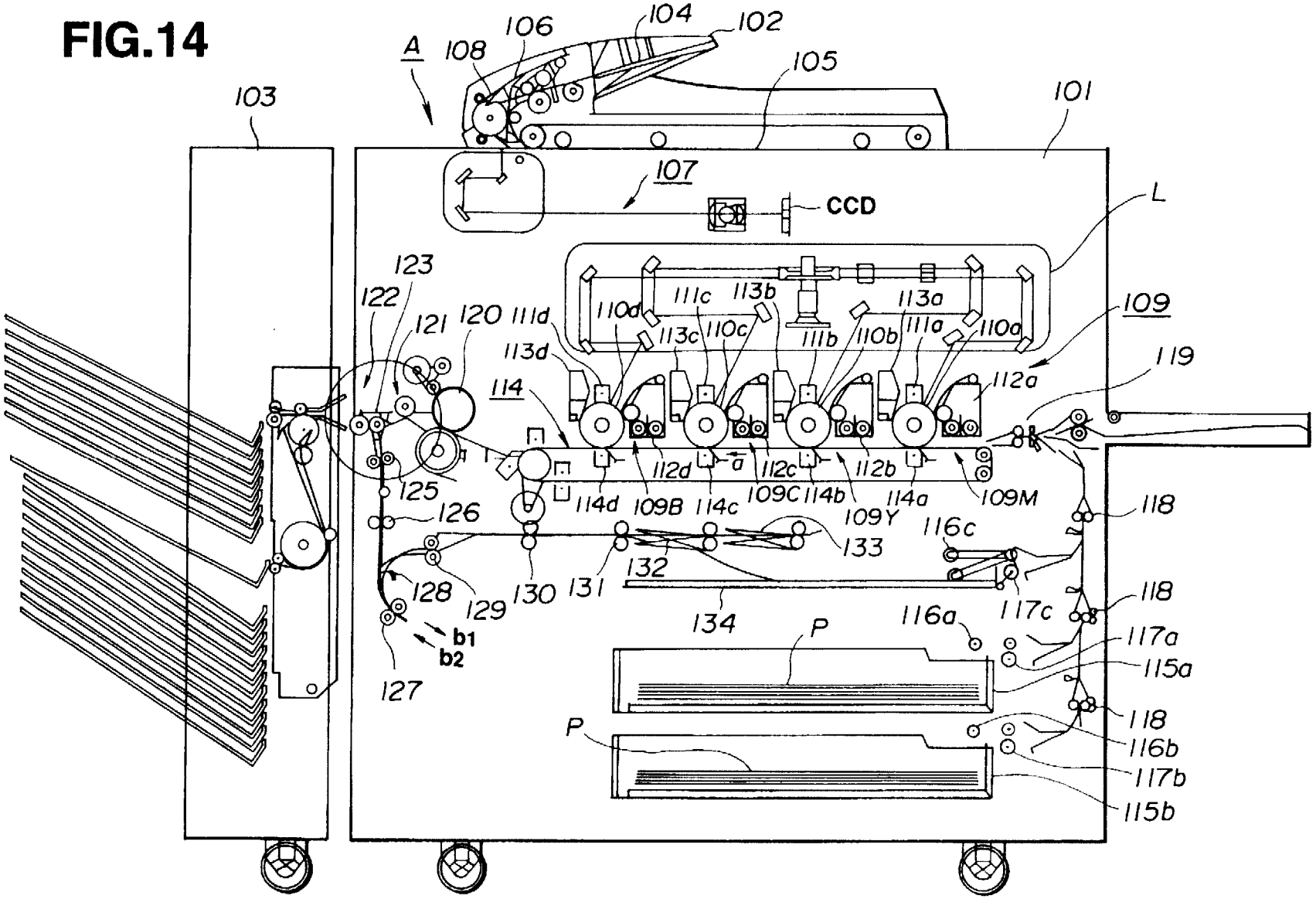
FIG. 14 is a schematic cross-sectional view illustrating a color copier capable of recording images on both surfaces of a sheet according to a seventh embodiment of the present invention.
Figure 15:
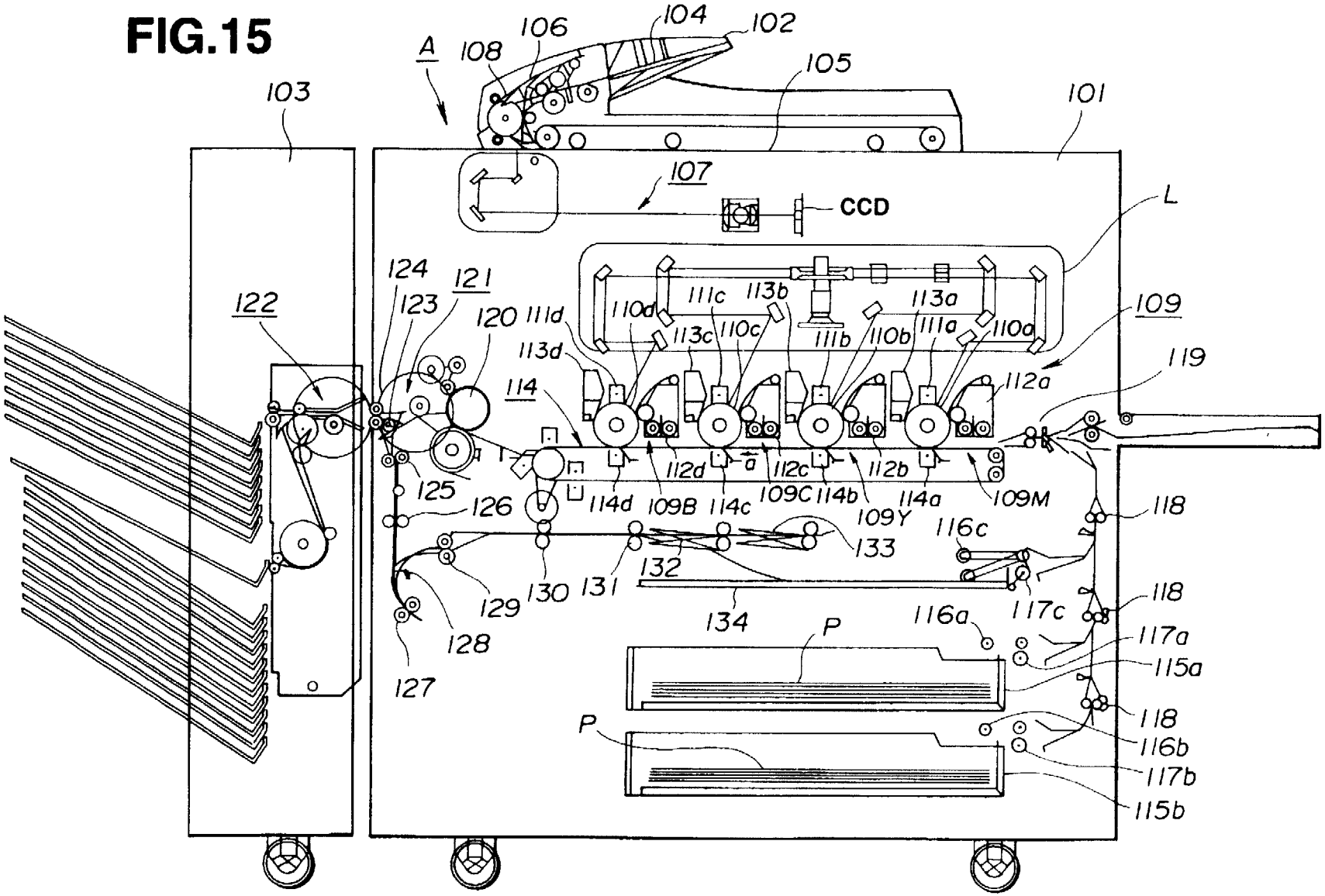
FIG. 15 is a schematic cross-sectional view illustrating a color copier capable of recording images on both surfaces of a sheet according to the seventh embodiment.

In the sixth embodiment, a description has been provided illustrating the configuration in which the pair of first curl correction rollers 121 are disposed within the main body 101 of the copier, and the pair of second curl correction rollers 122 are disposed at a space between the main body 101 of the copier and the sorting device 103. However, the present invention is not limited to such a configuration. For example, as shown in FIG. 14, a configuration, in which the pair of second curl correction rollers 122 are also disposed within the main body 101 of the copier, may be adopted. Alternatively, as shown in FIG. 15, a configuration in which the pair of second curl correction rollers 122 are disposed in the vicinity of a sheet conveying entrance of the sorting device 103, may be adopted. It is thereby possible to reduce the space of the main body 101 of the copier and the sorting device 103, and therefore to reduce the size of the entire image forming apparatus. Image forming operations of the image forming apparatuses shown in FIGS. 14 and 15, and sheet-curl correction operations by the pairs of first and second curl correction rollers 121 and 122 are the same as in the above-described sixth embodiment. Hence, a further description thereof will be omitted.

In the foregoing embodiments, the toner-amount detection means includes the potential sensor **9*e* (FIG. 1) for measuring potential on the photosensitive drum, and the amount of the toner is calculated based on the measured value. However, a light source for projecting light onto the surface of the photosensitive drum, and a reflected-light-amount sensor for measuring the amount of reflected light may be used instead of the potential sensor 9*e***. The amount of the toner is calculated by an arithmetic circuit from the measured value of the reflected-light-amount sensor.

Alternatively, a light source for projecting light onto the surface of the sheet after image transfer, and a reflected-light-amount sensor for measuring the amount of reflected light may be used. The amount of the toner is calculated by an arithmetic circuit from the measured value of the reflected-light-amount sensor.

As described above, according to the present invention, by storing image information of a first surface of a sheet in a memory, and providing means for determining the amount of correction of curl by comparing the stored information with image information of a second surface of the sheet, it is possible to appropriately correct curl of the sheet in accordance with the amount of the curl without providing a complicated device. Hence, conveyability of the sheet in a postprocessing device is improved, and postprocessing, such as sorting, stapling, punching, binding or the like, can be stably performed.

Although in the above-described embodiment, signals indicating the kind (ordinary paper or an OHP sheet), the thickness, and the size of the sheet are transmitted as sheet-kind information, the sheet-kind information is not limited to such information. In addition to the above-described information, the sheet-kind information may include information relating to at least one of the conveying direction of the sheet, the material of the sheet, the direction of carding, the density of the sheet, and the like.

The environment information may include at least one of the temperature and humidity within the image forming apparatus.

Each of the kind-information transmission means, the image-information transmission means and the environment-information transmission means in the above-described embodiments has a sensor which transmits a detection signal. However, a combination of a keyboard for manually inputting the above-described information by the user, and a memory for storing input data and transmitting the input data as a signal whenever necessary may also be adopted.

The individual components shown in outline or designated by blocks in the drawings are all well known in the curl correction device and image forming apparatus arts and their specific construction and operation are not critical to the operation or the best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A curl correction device of an image forming apparatus, said device comprising:

image forming means for forming images on first and second surfaces of a sheet;

first curl correction means for correcting curl in a first direction of the sheet;

second curl correction means for correcting curl in a second direction opposite to said first direction of the sheet;

kind-information transmission means for transmitting kind information relating to a kind of the sheet;

image-information transmission means for transmitting information relating to the images formed on the first and second surfaces of the sheet by said image forming means;

control means for changing a curl correction capability of at least said one of said first and second curl correction means based on the kind information transmitted from said kind-information transmission means, and image information of the first and second surfaces of the sheet transmitted from said image-information transmission means;

conveying means for conveying the sheet on which the image is formed by said image forming means;

a conveying path for leading the sheet on which the image is formed by said image forming means to said image forming means again;

a first leading path for leading the sheet to said first curl correction means, and then to said conveying means;

a second leading path for leading the sheet to said second curl correction means, and then to said conveying means;

first switching means for leading the sheet selectively to said first leading path or said second leading path; and second switching means for leading the sheet selectively to said conveying path, said second switching means being disposed downstream of said second curl correction means on said second leading path.

2. A device according to claim 1, wherein the kind information comprises information relating to at least one of size, conveying direction, material, thickness, direction of carding, and density of the sheet.

3. A device according to claim 1, wherein the image information comprises information relating to densities of the images formed on the first and second surfaces of the sheet.

4. A device according to claim 1, wherein at least one of said first curl correction means and said second curl correction means comprises a pair of rollers having different hardnesses, and wherein the curl correction capability can be changed by changing an amount of deformation of a soft roller caused by a hard roller while grasping and conveying the sheet in a state in which said soft roller is deformed by said hard roller in pressure contact therewith.

5. A device according to claim 1, further comprising environment-information transmission means for transmitting environment information including information relating to at least one of a temperature and a humidity within the image forming apparatus, wherein said control means changes the curl correction capability of at least one of said first and second curl correction means based on the kind information, the image information and the environment information of the sheet.

6. A device according to claim 1, wherein said control means changes the curl correction capability of at least one of said first and second curl correction means based on the difference between densities of the images formed on the first surface and the second surface.

7. A device according to claim 6, wherein at least one of said first and second curl correction means corrects the curl by bending the sheet so that a surface having a smaller image density from among the first surface and the second surface is at the inside of a curve of the sheet formed by bending the sheet.

8. A device according to claim 1, wherein at least one of said first curl correction means and said second curl correction means comprises a pair of rollers having different hardnesses, one of said pair being a hard roller and another of said pair being a soft roller, and wherein the curl is corrected by bending the sheet in a direction opposite to the direction of the curl by bending the sheet along the circumference of said hard roller while grasping and conveying the sheet in a state in which said soft roller is deformed by said hard roller in pressure contact therewith.

9. A device according to claim 8, wherein the curl correction capability can be changed by changing an amount of deformation of said soft roller by said hard roller.

10. A device according to claim 9, wherein a surface having a lower image density from among the first surface and the second surface is contacted to said hard roller.

11. A device according to claim 9, wherein the amount of deformation of said soft roller by said hard roller is changed by changing the distance between the rotation axes of said hard roller and said soft roller.

12. A device according to claim 11, wherein the curl correction capability is changed by changing the distance between the rotation axes of said hard roller and said soft roller steplessly or in multiple steps.

13. A device according to claim 8, wherein the curl correction capability is changed by changing the distance between the rotation axes of said hard roller and said soft roller.

14. A device according to claim 1, wherein said image forming means comprises an image bearing member for bearing a toner image, and forms an image on the sheet by transferring the toner image on said image bearing member onto the sheet.

15. A device according to claim 14, wherein said image-information transmission means measures an amount of toner by measuring a potential on said image bearing member, and transmits the image information based on the amount of the toner.

16. A device according to claim 14, wherein said image forming means comprises laser-beam emission means for emitting a laser beam based on pixel data in order to form a latent image on said image bearing member, and wherein said image-information transmission means counts a number of pixels in the pixel data and transmits the image information in accordance with the number of pixels counted.

17. A device according to claim 1, wherein said control means includes a graph indicating changes in the curl correction capability when the thickness of the sheet, and the difference between image densities of the first surface and the second surface are used as parameters, and controls the capability of at least one of said first and second curl correction means based on the graph.

18. A device according to claim 1, wherein at least one of said first correction means and said second curl correction means comprises a soft roller and a plurality of hard rollers harder than said soft roller, and wherein the curl is corrected by grasping and conveying the sheet in a state in which said soft roller is deformed by selectively pressing one of said plurality of hard rollers thereagainst, and bending the sheet in a direction opposite to the direction of the curl by selectively bending one surface of the sheet along the circumference of said one hard roller.

19. A device according to claim 18, wherein the curl correction capability can be changed by changing the amount of the deformation of said soft roller caused by said one hard roller.

20. A device according to claim 19, wherein said one hard roller is selected so as to contact a surface having a lower image density from among the first surface and the second surface to said one hard roller.

21. A device according to claim 1, wherein at least one of said first curl correction means and said second curl correction means comprises at least one rotating member, and a conveying belt for guiding the sheet to said rotating member to correct the curl of the sheet.

22. A device according to claim 21, wherein a plurality of rotating members are provided, and wherein curl correction in an arbitrary direction can be performed by selectively guiding the sheet between said conveying belt and one of said rotating members.

23. A device according to claim 1, wherein both said first and second curl correction means are provided at a side downstream from a fixing means of the image forming apparatus.

24. A device according to claim 1, wherein said image forming means comprises a plurality of image bearing members for bearing toner images having different colors, and wherein a color image is formed on the sheet by transferring the toner images on said plurality of image bearing members onto the sheet.

25. A curl correction device of an image forming apparatus, said device comprising:

an image bearing member for bearing an image to be transferred onto a sheet;

a conveying path for conveying the sheet from a downstream side to an upstream side of said image bearing member in order to form an image on a second surface of the sheet having an image formed on a first surface thereof;

first curl correction means for correcting curl of a sheet, comprising a pair of rotating members for grasping the sheet having the images formed on the first surface and the second surface thereof and for guiding the sheet so as to be bent in a direction opposite to the direction of curl;

second curl correction means for correcting the curl of a sheet;

a sheet-thickness sensor for detecting the thickness of the sheet;

a density sensor for detecting the densities of the images formed on the sheet;

a controller for changing a curl correction capability of said first curl correction means and said second curl correction means based on the thickness of the sheet detected by said sheet-thickness sensor, and the densities of the images on the two surfaces of the sheet detected by said density sensory;

conveying means for conveying the sheet on which the image is formed by said image bearing member;

a first leading path for leading the sheet to said first curl correction means, and then to said conveying means;

a second leading path for leading the sheet to said second curl correction means, and then to said conveying means;

first switching means for leading the sheet selectively to said first leading path or said second leading path; and second switching means for leading the sheet selectively to said conveying path, said second switching means being disposed downstream of said second curl correction means on said second leading path.

26. An image forming apparatus capable of recording images on both surfaces of a sheet material, said apparatus comprising:

heating fixing means for heating and fixing an image transferred onto a sheet material at an image forming portion;

inversion feeding means for inverting an image surface of the sheet material and guiding again the sheet material to the image forming portion;

discharging means for conveying and discharging the sheet material from said apparatus;

first curl-habit correction means for correcting curl habit of the sheet material, on which image formation has been performed, at a portion downstream from said heating fixing means in a sheet conveying direction and upstream from a branch portion of a conveying path, the conveying path dividing at the branch portion to a path leading to said inversion feeding means and a path leading to a conveying path to said discharging means; and second curl-habit correction means for correcting curl habit of the sheet material at a portion downstream from the branch portion.

27. An apparatus according to claim 26, each of said first and second curl-habit correction means comprising a hard roller and a soft rotating member, said hard roller having a diameter smaller than the diameter of a soft rotating member is disposed so as to face the soft rotating member, and wherein the sheet material is grasped and conveyed between the soft rotating member and the small-diameter hard roller.

28. An apparatus according to claim 27, wherein said soft rotating member comprises a soft belt member.

29. An apparatus according to claim 27, wherein said soft rotating member comprises a large-diameter soft roller.

30. An apparatus according to claim 26, wherein in said first curl-habit correction means, the soft rotating member is disposed at the upper-surface side of the sheet conveying path, and the hard roller having a diameter smaller than the diameter of the soft rotating member is disposed at the lower-surface side of the sheet conveying path.

31. An apparatus according to claim 26, wherein in said second curl-habit correction means, the soft rotating member is disposed at the lower-surface side of the sheet conveying path, and the hard roller having a diameter smaller than the diameter of the soft rotating member is disposed at the upper-surface side of the sheet conveying path.

32. An apparatus according to claim 26, wherein said first curl-habit correction means and said second curl-habit correction means are disposed within a main body of said image forming apparatus.

33. An apparatus according to claim 26, further comprising a sorting device capable of accommodating the sheet material, on which image formation has been performed, while classifying the sheet material, wherein said first curl-habit correction means is disposed within a main body of said image forming apparatus, and wherein said second curl-habit correction means is disposed within said sorting device.

34. A curl correction device of an image forming apparatus, said device comprising:

image forming means for forming an image on a surface of a sheet;

discharging means for discharging the sheet from said apparatus;

feeding means for feeding the sheet on which an image is formed by said image forming means to said image forming means again so that said image forming means forms an image on another surface of the sheet;

a sheet conveying path for guiding the sheet from said image forming means to said discharging means, said sheet conveying path being branched at a branch portion into a path leading to said feeding means;

curl correction means for correcting curl of the sheet;

image-information transmission means for transmitting information relating to the images formed on both the surfaces of the sheet transmitted from said image-information transmission means;

control means for changing a curl correction capability of said curl correction means based on the image information of both the surfaces of the sheet transmitted from said image-information transmission means, wherein said curl correction means comprises first curl correction means for correcting curl of the sheet and second curl correction means for correcting curl of the sheet, said first curl correction means being disposed on said sheet conveying path upstream from said branch portion, and said second curl correction means being disposed on said sheet conveying path downstream from said branch portion.

35. A device according to claim 34, wherein said image forming means comprises an image bearing member for bearing a toner image, and forms an image on the sheet by transferring the toner image on said image bearing member onto the sheet.

36. A device according to claim 34, wherein said image-information, transmission means measures an amount of toner by measuring a potential on an image bearing member, and transmits the image information based on the amount of the toner.

37. A device according to claim 34, wherein said image forming means comprises laser-beam emission means for emitting a laser beam based on pixel data in order to form a latent image on an image bearing member, and wherein said image-information transmission means counts a number of pixels in the pixel data and transmits the image information in accordance with the number of pixels counted.

38. A device according to claim 34, wherein said control means includes a graph indicating changes in the curl correction capability when the thickness of the sheet, and the difference between image densities of the first surface and the second surface are used as parameters, and controls the capability of the curl correction means based on the graph.

39. A device according to claim 34, wherein said image forming means comprises a plurality of image bearing members for bearing toner images having different colors, and wherein a color image is formed on the sheet by transferring the toner images on said plurality of image bearing members onto the sheet.

40. A curl correction device of an image forming apparatus, said device comprising:

image forming means for forming an image on a surface of a sheet;

conveying means for conveying the sheet;

feeding means for feeding the sheet on which an image is formed by said image forming means to said image forming means again so that said image forming means may form an image on another surface of the sheet;

a sheet conveying path for leading the sheet from said image forming means to said conveying means, said sheet conveying path being branched at a branch portion into a path leading to said feeding means;

first curl correction means, being disposed upstream of said branch portion on said sheet conveying path, for correcting curl in a first direction of the sheet;

second curl correction means, being disposed downstream of said branch portion on said sheet conveying path, for correcting curl in a second direction opposite to said first direction of the sheet;

wherein one of said first curl correction means and said second curl correction means does not correct curl of the sheet according to the direction of the curl of the sheet.

41. A curl correction device according to claim 40, wherein said first curl correction means corrects the curl wherein the surface on which said image forming means has formed an image is concave.

* * * * *

UNITED STATES PATENT AND TRADEMARK OFFICE

CERTIFICATE OF CORRECTION

PATENT NO. : 5,787,331

DATED : July 28, 1998

INVENTOR(S) : KEIKO OHKUMA, ET AL.

It is certified that error appears in the above-identified patent and that said Letters Patent is hereby corrected as shown below:

On the title page,

Item [73] ASSIGNEE:

"Japan" should read --Tokyo, Japan--.

COLUMN 4:

Line 39, "combshaped" should read --comb-shaped--; and

Line 55, "in an" should read --in a--.

COLUMN 7:

Line 19, "the the"should read --to the--; and

Line 21, "high temperature" should read --high-temperature--.

COLUMN 8:

Line 55, "inversecurl" should read --inverse-curl--.

COLUMN 9:

Line 38, "sheetcurlhabit" should read --sheetcurl-habit--.

UNITED STATES PATENT AND TRADEMARK OFFICE

CERTIFICATE OF CORRECTION

PATENT NO. : 5,787,331

DATED : July 28, 1998

INVENTOR(S) : KEIKO OHKUMA, ET AL.

It is certified that error appears in the above-identified patent and that said Letters Patent is hereby corrected as shown below:

COLUMN 18:

Line 50, "information," should read --information--;

and

Line 64, "sheet," shoudl read --sheet-.

Signed and Sealed this

Thirteenth Day of April, 1999

*Attest:*

Q. TODD DICKINSON

*Attesting Officer*

*Acting Commissioner of Patents and Trademarks*